United States Patent [19]

Hashimoto et al.

[11] Patent Number: 4,828,954

[45] Date of Patent: May 9, 1989

[54] TONER COMPOSITION WITH TREATED INORGANIC POWDER

[75] Inventors: Ken Hashimoto; Hideaki Akagi, both of Kanagawa, Japan

[73] Assignee: Fuji Xerox Co., Ltd., Tokyo, Japan

[21] Appl. No.: 85,109

[22] Filed: Aug. 14, 1987

[30] Foreign Application Priority Data

Aug. 14, 1986 [JP] Japan ..... 61-189502

[51] Int. Cl.[4] ..... G03G 9/08

[52] U.S. Cl. ..... 430/110; 430/137

[58] Field of Search ..... 430/110, 137

[56] References Cited

U.S. PATENT DOCUMENTS 4,288,517 9/1981 Arimatsu et al. ..... 430/110
4,621,039 11/1986 Ciccarelli et al. ..... 430/110 X

FOREIGN PATENT DOCUMENTS 55-135855 10/1980 Japan ..... 430/110
57-78556 5/1982 Japan ..... 430/110
60-57852 4/1985 Japan ..... 430/110
60-217368 10/1985 Japan ..... 430/110
61-148454 7/1986 Japan ..... 430/110
62-52564 3/1987 Japan ..... 430/110

*Primary Examiner*—Roland E. Martin
*Attorney, Agent, or Firm*—Sughrue, Mion, Zinn, Macpeak & Seas

[57] ABSTRACT

A toner composition is disclosed, which contains an inorganic powder having been subjected to surface treatment with a compound having an onium salt structure, containing no polymerizable unsaturated bond, and having a functional group capable of bonding to an inorganic substance. The toner composition satisifies both charging properties, such as rapid onset of charging, controllability of charge quantity and charge distribution, environmental stability, physical and chemical stability, and stability with time, and non-electrical requirements, such as powder fluidity, anti-blocking properties, and cleanability.

20 Claims, 1 Drawing Sheet

TONER COMPOSITION WITH TREATED INORGANIC POWDER

FIELD OF THE INVENTION

This invention relates to a toner composition for development in electrophotography or electrostatic recording to produce a visible image from an electrostatic latent image or electrical signals, and more particularly to a toner composition for development of an electrostatic image, which exhibits excellent performance in charging, development, and transfer.

BACKGROUND OF THE INVENTION

Known techniques for charging a toner include triboelectric charging, ion irradiation, electrostatic induction utilizing conductivity, charge intoduction, and the like. Among them, the triboelectric charging is the most convenient and broadly adopted. Developers for the triboelectric charging technique include a two-component system, including a mixture of a toner and carrier particles charged to the opposite polarity of the toner, charge and a one-component system utilizing static charging between a charging blade or a charging roll, etc. and a toner or charging of toner particles.

According to this technique, charge control is effected by addition of an electron donating or attracting substance to the toner or the charge-imparting material, such as a carrier and a blade. The triboelectric charging phenomenon is complicated, and its mechanism has not been completely elucidated. In general, an electron donating substance is positively charged, while an electron attracting substance is negatively charged.

More specifically, charge control has been conventionally carried out by (i) using charge control agents, such as dyes, pigments, surface active agents, inorganic powders, etc. mixed with the toner or adhered onto the toner surface, or (ii) using resinous materials having a functional group, such as —COOH, —CN, a halogen (e.g., —Cl), —$NO_2$, —$NH_2$, etc., as a binder.

However, use of the above-described conventional charge control agents has not fully satisfied the requirements on charge control necessary to provide charge stability against the passage of time and environmental changes.

Further, a colorless or pale-colored charge control agent which can be used satisfactorily for a color developer has not yet been developed.

Frequently, an organic and/or inorganic powder in a particulate, fibrous or plate-like form is incorporated into the inside of toner particles or adhered onto the outer surface of toner particles for various purposes, not limited to charge control, such as improvement of powder fluidity or the anti-blocking properties of a toner, improvement of cleanability of a toner on the surface of a toner image-receiving element, e.g., a photoreceptor, control of rheological characteristics of a toner per se, and the like. In these cases, too, since the inorganic or organic powder added naturally influences the electrical characteristics of a toner, including charging properties, not only the electrical characteristics of the powder per se but also the compatibility between the powder and the toner are of great importance.

In the case of a negatively charging toner, silica or other fine powders are frequently added. However, addition of such silica or other fine powders to a positively charging toner deteriorates the charging properties of the toner. In order to overcome this problem, it has been proposed to use a silica or other fine powder subjected to surface treatment with positively charging compounds containing an amino group or a modified amino group to effect charge control, as disclosed in Japanese Patent Publication No. 22447/78 and Japanese Patent Application (OPI) Nos. 79254/83, 43456/84, and 189352/84 (the term "OPI" as used herein means "unexamined published Japanese Patent application").

While these techniques provide a limited improvement, the toner still has problems of stability over time, environmental stability, and physical and chemical stability when used for repeated copying. An additive for a positively charging toner which satisfies both non-electrical requirements and electrical requirements has not yet been developed.

SUMMARY OF THE INVENTION

Accordingly, one object of this invention is to provide a toner composition which charges quickly, provides control of charge quantity and charge distribution, and exhibits excellent environmental stability, physical and chemical stability, and stability over time.

Another object of this invention is to provide a toner composition which has improved performance in development and transfer, that consistently provides a high-quality color image.

A further object of this invention is to provide a toner composition containing a colorless or pale-colored charge control agent which is suitable for use in color development.

A still further object of this invention is to provide a toner composition which satisfies both requirements of charging properties and non-electrical functions, such as powder fluidity, anti-blocking properties, cleanability, etc.

It has now been found that these and other objects of the present invention can be accomplished by incorporating an inorganic powder into a toner composition, the inorganic powder having been subjected to surface treatment with a compound having an onium salt structure containing no polymerizable unsaturated bond, and having a functional group capable of bonding to an inorganic substance.

BRIEF DESCRIPTION OF THE ACCOMPANYING DRAWING

FIG. 1 illustrates a developing machine in which the toner composition according to the present invention is used as a one-component developer.

DETAILED DESCRIPTION OF THE INVENTION

Figure 1:
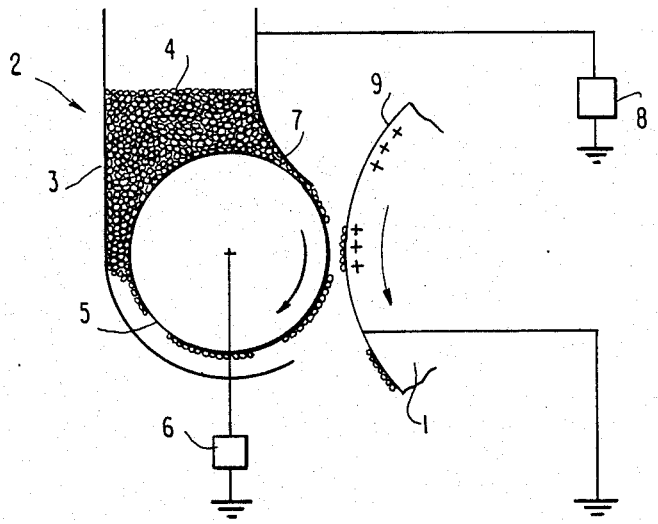

The onium salt structure of the compound used as a surface treating agent in the present invention is composed of a cationic component and an anionic component. Examples of the cationic components include:

(a) simple amine cations, including:

primary amine salts represented by formula (I):

$$R_1-\overset{\oplus}{N}H_3, \qquad (I)$$

secondary amine cations represented by formula (II):

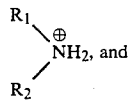

(II)

tertiary amine cations represented by formula (III);

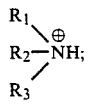

(III)

(b) modified amine cations, including those represented by formulae (IV), (V), and (VI):

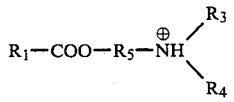

(IV)

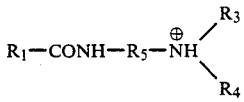

(V)

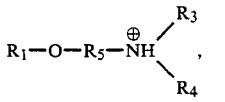

(VI)

(c) quaternary ammonium cations represented by formula (VII):

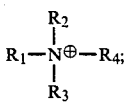

(VII)

(d) modified quaternary ammonium cations including those represented by formulae (VIII), (IX) and (X):

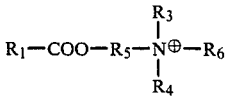

(VIII)

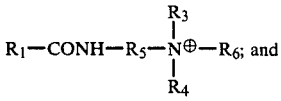

(IX)

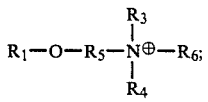

(X)

(e) trialkylbenzyl quaternary ammonium cations, (f) phosphonium cations represented by formula (XI)

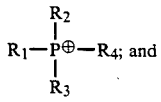

(XI)

sulfonium cations represented by formula (XII):

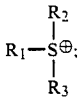

(XII)

wherein $R_1$, $R_2$, $R_3$, $R_4$, and $R_6$ which may be the same or different, each represents a halogen atom and an organic group, provided that any of $R_1$, $R_2$, $R_3$, $R_4$, and $R_6$ may be linked to form a cyclic group, and $R_5$ represents a divalent organic group. Examples of the anionic components include halogen anions (e.g., $Cl^{\ominus}$, $Br^{\ominus}$, and $F^{\ominus}$), groups having $-COO^{\ominus}$or $-SO_3^{\ominus}$(e.g., $CH_3COO^{\ominus}$and

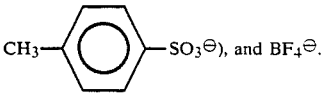

In the above formulae, preferred groups represented by $R_1$, $R_2$, $R_3$, $R_4$, and $R_6$ include a halogen atom (F, Cl, Br, I), an alkyl group having from 1 to 30 carbon atoms (more preferably from 1 to 20 carbon atoms), a haloalkyl group having from 1 to 10 carbon atoms (more preferably from 1 to 5 carbon atoms), an aralkyl group having from 7 to 21 carbon atoms (more preferably from 7 to 19 carbon atoms) and an aryl group having from 6 to 20 carbon atoms (more preferably from 6 to 18 carbon atoms); and $R_5$ preferably represents a divalent group derived from those (other than a halogen atom) represented by $R_1$, $R_2$, $R_3$, $R_4$, and $R_6$ as set forth above.

Of these onium salt structures, ammonium salts classified as lower amine salts, tertiary ammonium salts and quaternary ammonium salts are advantageously used both for their properties and economy of production, and tertiary or quaternary ammonium salts are particularly preferred.

The term "ammonium salts" as used herein includes not only the above-mentioned lower amine salts, tetraalkylammonium salts, modified trialkylammonium salts, trialkylbenzylammonium salts, tetrabenzylammonium salts, etc. but also cyclic ammonium salts, e.g., pyridinium salts, quinolinium salts, imidazolinium salts, morpholinium salts, etc.

The compounds having the above-described onium salt structure should not contain any polymerizable unsaturated bond in the molecule thereof. The term "polymerizable unsaturated bond" as used herein means a radical polymerizable unsaturated bond, such as a vinyl group, a methacryl group, etc., as represented by formula

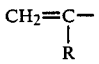

wherein R represents a hydrogen atom or an organic group.

Those compounds having an unsaturated bond in a benzene ring or a pyridine ring exhibit high stability, in contrast to compounds containing the above-described radical polymerizable unsaturated bond, e.g., a vinyl group, which adversely affects the physical and chemical stability of a toner. More specifically, use of compounds having an onium salt structure containing a radical polymerizable unsaturated bond, e.g., a vinyl group, as a surface treating agent causes blurring of the image or disappearance of the image, on copying under poor conditions. It is not clear why the surface treating agents according to the present invention containing no radical polymerizable unsaturated bond avoid these disadvantages. Without being bond by theory, it is assumed that these problems are attributable to chemical reactions or deterioration of the moiety containing the radical polymerizable unsaturated bond under poor copying conditions, such as high temperature, high humidity, high electrical field and high ozone concentration in a copying machine, and the like.

In the present invention, the compounds having the onium salt structure should have at least one functional group capable of bonding to an inorganic substance.

The functional group capable of bonding to an inorganic substance may be any of an acidic group, a basic group, and the like as long as it is capable of bonding to a hydroxyl group on a surface of an anhydrous substance, an adsorbed water layer, etc. In general, preferred functional groups are capable of reacting with inorganic substances which are employed in coupling agents for linking inorganic substances and organic substances, i.e., silane coupling agents, titanate coupling agents, aluminate coupling agents, zirconate coupling agents, chromium complexes, and other metal-containing coupling agents. The silane coupling agents, which are representative of these coupling agents and advantageous from various viewpoints, are now explained in greater detail.

The silane coupling agents are represented by formula (XIII):

$$X_mSiY_n \quad \text{(XIII)}$$

wherein X represents a group capable of reacting with an inorganic substance, such as a halogen atom (e.g., Cl) and an alkoxy group (e.g., a methoxy group, an ethoxy group, etc.); Y represents a group capable of reacting with an organic substance (e.g., a vinyl group, an amino group, a chlorine atom, an epoxy group, a mercapto group, etc.); m and n which may be the same or different each represents an integer of from 1 to 3, and when m or n is at least 2, the plural groups represented by X or Y may be the same or different.

The compounds having an onium salt structure which can be used in the present invention as a surface treating agent preferably contain a halogen atom (e.g., a chlorine atom, etc.) or an alkoxy group (e.g., a methoxy group, an ethoxy group, etc.) as a functional group capable of bonding to an inorganic substance.

The surface treating agents to be used in the present invention preferably include organic silane compounds in view of molecular design freedom and effects attained. Among the organic silane compounds, more preferred are those represented by formula (XIV)

$$X'_mSiZ_n \quad \text{(XIV)}$$

wherein X' represents a chlorine atom or an alkoxy group; Z represents a saturated hydrocarbon group containing an ammonium base or a non-polymerizable unsaturated hydrocarbon group containing an ammonium base; and m and n are as defined above; in formula (XIII) when m or n is 2 or more, the plural groups represented by X or Z may be the same or different; when n is 2 or more, at least one of the plural groups represented by Z contains an ammonium base.

The most preferred organic silane compounds of formula (XIV) are those in which all groups represented by Z other than the ammonium base-containing group are saturated hydrocarbon groups.

The inorganic powders treated with the above-described surface treating agent include silica, mixed oxides of silicon and other metallic elements (e.g., talc, clay, kaolin, zeolite, cordierite, murite, mica, etc.), silicon carbide, silicon nitride, silicon, boron nitride, tin oxide, zinc oxide, titanium oxide, alumina, barium titanate, potassium titanate, calcium carbonate, dolomite, barium sulfate, cerium oxide, chromium oxide, iron oxide, ferrites, molybdenum oxide, nickel oxide, magnesium oxide, magnesium hydroxide, zirconium oxide, vanadium oxide, iron, nickel, aluminum, gold, silver, copper, zinc, copper iodide, carbon black, graphite, diamond, amorphous carbon, and the like.

The shape of these inorganic powders can be selected without particular limitation from spherical, particulate, needle-like, fibrous and plate-like forms, and the like.

The particle size of the inorganic powder is appropriately selected in the range of from about 0.001 μm to several tens of micrometers, and is preferably from about 0.005 μm to about 5 μm. When, in particular, the inorganic powder is incorporated into the inside of toner particles or externally added to the surface of toner particles to form a relatively uniform layer, a powder having a particle size of from about 0.005 μm to about 0.5 μm is preferred.

In carrying out the surfac treatment, two or more kinds of surface treating agents may be used in combination.

If desired, a treating agent other than the above-described surface treating agent may be used in combination. Examples of suitable auxiliary treating agents include organic hydrophobic silicon compounds (e.g., dimethyldichlorosilane, methyltrichlorosilane, trimethylchlorosilane, trimethylethoxysilane, dimethyldimethoxysilane, phenyltriethoxysilane, octadecyltriethoxysilane, hexamethyldisilazane, etc.), vinylsilanes (e.g., vinyltrichlorosilane, etc.), aminosilanes (e.g., γ-aminopropyltriethoxysilane, etc.), perfluorosilanes, glycidoxysilanes, methacryloxysilanes, silanes having a mercapto group or an isocyanate group, silicone oils inclusive of modified silicone oils, titanate coupling agents, zirconium coupling agents, aluminum coupling agents, higher fatty acids and derivatives thereof (e.g., esters, amides, metal salts, etc.), higher alcohols and derivatives thereof, surface active agents, dyes, and so on.

The surface treatment of the inorganic powder with the surface treating agent having an onium salt structure, e.g., ammonium salt, can be carried out by, for example, a dry method, a wet method or slurry method, or a spray method. In the dry method, the inorganic powder is sprayed with an aqueous solution of the surface treating agent while stirring the inorganic powder using a mixer such as V-type mixer, Henschel mixer, etc. to thereby uniformly coating the surface treating agent on the powder surface, followed by drying. It is preferred that the treatment be carried out using a mixer having a vent hole and equipped with a spray head at the center and that the sprayed mist be accompanied by dry air or nitrogen gas. According to the wet method or slurry method, the inorganic powder is dispersed in water or an organic solvent to which the surface treating agent is added with stirring, followed by dehydration and drying. Alternatively, the inorganic powder is dipped in an aqueous solution or organic solvent solution of the surface treating agent while stirring, followed by heating to remove the solvent. According to the spray method, a solution of the surface treating agent is sprayed on the inorganic powder which has just been taken out from an oven. It is also possible to suspend the inorganic powder in a gaseous phase and apply a solution of the surface treating agent by spraying or vaporization.

Treatment with coupling agents or surface treating agents other than the surface treating agents of the present invention may be performed simultaneously with the abovedescribed surface treatment or before or after the surface treatment.

It is desirable that the thus-treated inorganic powder be subjected to heat treatment. Such heat treatment is preferably effected at a temperature not higher than about 200° C., since too a high treating temperature induces decomposition or denaturation of the surface treating agent, and more preferably at a temperature around 100° C., though this temperature can be varied depending on the chemical structure of the surface treating agent used.

The amount of the surface treating agent used in the present invention varies depending on the purpose, the end use, and the structure of the surface treating agent used, it is generally from about 0.5 to 2.0 wt % based on the amount of the inorganic powder. The effects of the surface treating agents of the present invention are sufficient if the surface treating agents are used in an amount necessary for forming a monomolecular layer or less. If necessary, an amount sufficient to form two or more molecular layers may be employed.

The surface treating agent according to the present invention not only produces highly satisfactory positive charge control, but greatly influences the electrical conductivity of a toner. Therefore, when semi-conductivity or low insulating properties are required the surface treatment is preferably conducted using the surface treating agent in an amount sufficient to form a monomolecular layer or even higher. On the other hand, when surface treatment is effected with the primary aim of controlling positively charging properties in an apparent insulating area, the inorganic powder is preferably coated with the surface treating agent in an amount less than that required for forming a monomolecular layer. In this case, it is sufficient to apply an amount of about 50% or less of the amount necessary for forming a monomolecular layer.

It has not been experimentally varified whether or not the functional group of the surface treating agent according to the present invention is actually bonded to a hydroxyl group, etc. on the surface of inorganic substances through a chemical reaction. However, without being board by theory, considering the fact that the effects of the surface treatment are very stable, the surface treating agent is believed to be firmly held or adsorbed on the surface of the inorganic powder due to a strong mutual attraction, such as a hydrogen bond, if the functional group is not bonded to the surface of the inorganic powder. As used herein, the term "bonded" is not limited to covalent or ionic bonds, but includes any strong material attraction of molecules.

In many cases, the inorganic powder, which usually has a hydrophilic surface, is rendered hydrophobic upon being treated with the surface treating agent according to the present invention.

In cases where the thus-treated inorganic powder is incorporated into the inside of toner particles, it is used in an amount of from about 0.1 to 30 vol %, and preferably from about 1 to 20 vol %, based on the toner particles.

In cases where the surface-treated inorganic powder is externally added to the surface of toner particles, it is used in an amount of from about 0.01 to 20 wt %, and preferably from about 0.1 to 10 wt %, based on the toner particles. After the external addition, the surface treating agent supplied may be fixed to or buried in the surface of the toner particles by means of heat treatment, chemical treatment, or a similar technique.

When the surface-treated inorganic powder has a particle size equal to or larger than that of toner particles, the amount of the powder to be used may be properly determined according to the end use.

Since the inorganic powder surface-treated in accordance with the present invention produces significant effects in control of positively charging properties and conductivity of a toner as described above, it is very effective when used as a charge control agent for positively charging toners, when incorporated into the inside of toner particles and/or externally applied to toner particles. Further, it may also be added to negatively charging toners in order to provide minute control of the charge exchange of a developer, providing a charge to a toner through on a charging mechanism, such as mutual charging among toner particles, or to prepare of a toner capable of being ampholytically charged, and the like.

In addition to the above-mentioned effects, the surface-treated inorganic powder in accordance with the present invention greatly improves the anti-blocking properties of a toner, powder fluidity, and cleanability, particularly when added to the surface of the toner particles.

In the preparation of the toner composition of the present invention, any known binder resins can be used. Specific but non-limiting example of useful binder resins include styrene/acrylic copolymers, styrene/butadiene copolymers, polyesters, polyamides, epoxy resins, polycarbonates, polyurethanes, silicone resins, fluorine-containing resins, polyolefins (e.g., plyethylene, polypropylene, etc.), ethylene/vinyl acetate copolymers, and so on. These resins may be either heat fixable or pressure fixable.

The toner composition according to the present invention may further contain other known additives, such as charge control agents (e.g., carbon black, metallized dyes, Nigrosine, quaternary ammonium salts, etc.); cyan, magenta, yellow or other chromatic dyes or pigments; magnetic substances (e.g., magnetite, $\gamma$-hematite, ferrite, etc.); conductivity control agents (e.g., tin oxide, copper iodide, etc.); reinforcements, releasing agents, and the like.

When the surface-treated inorganic powder is used as an external additive for the toner, it is most advantageous for positive charge control when (i) an ammonium salt having a structure analogous to that of the surface treating agent of the present invention, such as a lower amine salt, a quaternary ammonium salt, a pyridinium salt, etc., is present in a binder resin or (ii) a binder resin contains an ammonium salt structure in its molecular terminal group or a side chain.

The toner composition of the invention may furthermore contain known external additives, such as silica, carbon, alumina, titanium oxide, zinc oxide, resin fine powders, tin oxide, etc.

The toner composition of the present invention can be prepared by any conventional processes, such as kneading-pulverizing, spray drying, direct polymerization, and the like. The various additives can be blended in accordance with any known technique.

The toner particles preferably have an average particle size ($d_{50}$: a particle size at 50% in the cumulative weight distribution of the toner particles) ranging from about 1 to 20 μm, and preferably from about 5 to 15 μm, as measured according to Coulter counter method (according to PRODUCT REFERENCE MANUAL of coulter counter Model TA-II type produced by coulter electronics Inc.)

In printing electrostatic latent images or other electrical signals, the toner composition of the invention can be applied to either two-component system development using a carrier, or a one-component system development without carrier. The toner composition of the invention can also be applied to color image development.

It is also possible to utilize the surface-treated inorganic powder of the present invention as a carrier by itself, or as an additive for a carrier material or a blade/roll charging material, to control the charging properties of a toner.

The toner composition containing the inorganic powder surface treated with the compound according to the present invention charges quickly and charging can be controlled easily to provide a proper charge quantity with a proper charge distribution. The surface-treated inorganic powder is particularly effective to control the positive charging properties and conductivity of a toner. Further, the composition is superior in environmental stability, physical and chemical stability and stability over time. Furthermore, the toner composition satisfies both requirements for charging properties of a toner and non-electrical requirements, such as powder fluidity, anti-blocking properties, cleanability, and the like, and, therefore, assures an image of high quality.

In addition, since the surface treating agent used in the present invention is colorless or pale-colored, the toner composition is suitable as a color developer for color image formation.

The present invention will now be illustrated in greater detail by way of the following examples, but the present invention is not to be construed as being limited thereto. In these examples, all parts, and ratios are by weight unless otherwise indicated. The terms "Tg", "Mn", and "Mw" refer to "glass transition temperature", "number average molecular weight", and "weight average molecular weight", respectively.

In the following examples, relative triboelectric values generated by contact of toner particles with carrier particles are measured by means of a Faraday Cage (blow-off tribometer). This device comprises a stainless steel cylinder having a diameter of about 1 inch and a length of about 1 inch. A screen is positioned at each end of the cylinder; the screen openings are of such a size as to permit the toner particles to pass through the openings but prevent the carrier particles from making such passage. The Faraday Cage is weighed, charged with about 0.5 gram of the carrier particles and toner particles, reweighed, and connected to the input of a coulomb meter. Dry compressed air is then blown through the cylinder to drive all the toner particles from the carrier particles. As the electrostatically charged toner particles leave the Faraday Cage, the oppositely charged carrier particles cause an equal amount of electronic charge to flow from the Cage, through the coulomb meter, to ground. The coulomb meter measures this charge which is then taken to be the charge on the toner which was removed. Next, the cylinder is reweighed to determine the weight of the toner removed. The resulting data are used to calculate the average charge to mass ratio of the toner particles.

Further, the charge distribution was measured using a charge spectrograph according to the method described in Japanese Patent Application (OPI) No. 79958/82, wherein the toner particles triboelectrically charged by mixing with the carrier particles was blown off to pass through a parallel electrical field in a vertical direction to the electrical field, and the throw-distance of the toner which varies depending on the charge quantity of the toner particles due to the electrical field was measured, from which the charge distribution of the toner particles was measured.

EXAMPLE 1

| | |
|---|---|
| Styrene/n-butyl methacrylate copolymer (Tg: 65° C.; Mn: 14,000; Mn: 45,000) | 90 parts |
| Carbon black (pH = 8; Regal 330 produced by Cabot Co.) | 7 parts |
| Modified Nigrosine (Bontron N-03 produced by Orient Chemical Co., Ltd.) | 3 parts |

A mixture consisting of the above components was kneaded, pulverized and classified to obtain toner particles having an average particle size ($d_{50}$) of 12 μm. The resulting toner was designated as Toner 1*a*.

Toner 1*a* was mixed with an iron powder carrier having an average particle size of about 100 μm to prepare a two-component developer having a toner concentration (=100×Toner/(Toner+Carrier)) of 3 wt %.

The average charge quantity and charge distribution of the developer were determined by means of a blow-off tribometer and a charge spectrograph. As a result, the average charge quantity almost reached saturation in 1 minute from the mixing of the developer, but the charge quantity (t=1 minute) varied considerably depending on environmental conditions as shown in Table 1 below.

TABLE 1

| Measurement: Condition | Charge Quantity |
|---|---|
| 22° C., 55% RH | about +10 μC/g |
| 10° C., 15% RH | about +12 μC/g |
| 30° C., 85% RH | about +6 μC/g |

Further, the toner was slow in charging, had a broad charge distribution, and contained a large proportion of toner particles charged to an opposite polarity.

The toner was also found to have a powder compressibility of about 45% and poor powder fluidity as measured by a powder testor.

Toner 1*a* was then mixed with 0.8 wt % (based on the amount of the toner) of a silica fine powder (Aerosil 130 produced by Nippon Aerosil Co.; obtained by a combustion hydrolysis process; particle size: about 0.016 μm) which had been subjected to surface treatment with an organic silane compound of formula

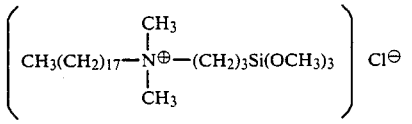

in a Henschel mixer to prepare Toner 1*b*. The surface treatment of the silica fine powder (Aerosil 130) was carried out by suspending the powder in a gaseous phase, spraying a solution of the silane compound in a mixed solvent of methanol and water (a ratio of silane compound/methanol/water: 1/50/50) at a ratio of silica/silane compound of 100/15, dried at 40° C. for 20 min, and heat treated at about 100° C. for 120 min.

Toner 1*b* was mixed with an iron carrier and the resulting developer was evaluated for charging properties in the same manner as a described above. The results obtained are shown in Table 2 below.

TABLE 2

| Measurement Condition | Charge Quantity |
|---|---|
| 22° C., 55% RH | about +20 μC/g |
| 10° C., 15% RH | about +19 μC/g |
| 30° C., 85% RH | about +15 μC/g |

The developer charged rapidly, had a narrow charge distribution, and contained substantially no toner particles charged to an opposite polarity.

Further, the developer had a powder compressibility as low as about 36 wt % and greatly improved powder fluidity.

When the resulting developer was used in a copying machine (a modified "FX-2300" manufactured by Fuji Zerox Co., Ltd.) having a negatively charging organic photoreceptor, 30,000 satisfactory copies were consistently obtained under a wide range of environmental conditions of from low temperature (10° C.) and low humidity (15% RH) to high temperature (30° C.) and high humidity (85% RH).

COMPARATIVE EXAMPLE 1

Toner is as prepared in Example 1 was mixed with 0.8 wt % of Aerosil 130 (untreated) to prepare Toner 1*c*.

Toner 1*d* was prepared by mixing Toner 1*a* with 0.8 wt % of Aerosil R-972 (a trade name for a silica fine powder obtained by rendering Aerosil 130 hydrophobic by treatment with dimethyldichlorosilane; produced by Nippon Aerosil Co., Ltd.).

Toner 1*e* was prepared by mixing Toner 1*a* with 0.8 wt % of aminosilane-treated silica which was prepared by treating Aerosil 130 with an aminosilane compound of formula $$NH_2CH_2CH_2NHCH_2CH_2CH_2Si(OCH_3)_3$$

in the same manner as described in Example 1, except that the silica/silane compound ratio was changed to 100/10.

Toner 1*f* was prepared by mixing Toner 1*a* with 0.8 wt % of Aerosil 130 subjected to surface treatment with a silane coupling agent having an unsaturated bond and an ammonium salt structure as represented by formula

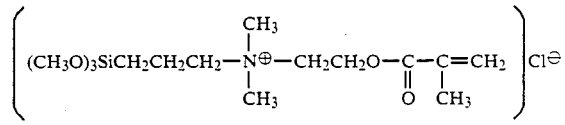

in the same manner as described in Example 1, except that the silica/silane compound ratio was 100/10.

Further, Aerosil 130 was surface treated in the same manner as in the preparation Toner 1*f*, except that the silica/silane compound ratio was changed to 100/2, and was then rendered hydrophobic by further treating with dimethyldichlorosilane at a silica/dimethyldichlorosilane ratio of 100/5. Toner 1*a* was mixed with 0.8 wt % of the thus treated silica to prepare Toner 1*g*.

Each of the resulting toners was evaluated for charging properties in the same manner as in Example 1. As a result, it was found that Toner 1*c* and Toner 1*d* had low charge quantities under all environmental condition, i.e., an average of less than about +5 μC/g, and contained several tens of weight percent of particles charged to an opposite polarity and, therefore, were not practically useful as a positively charging toner.

The results for Toner 1*e* were as follows.

TABLE 3

| Measurement Condition | Charge Quantity |
|---|---|
| 22° C., 50% RH | about +23 μC/g |
| 10° C., 15% RH | about +18 μC/g |
| 30° C., 85% RH | about +5 μC/g |

As is shown in Table 3, Toner 1*e* had charging properties sufficient for practical use under normal temperature and humidity conditions or low temperature and low humidity conditions, but had a broad charge distribution and contained a large quantity of particles charged to an opposite polarity when compared with Toner 1*b* of Example 1. Further, Toner *e* exhibited a very significant reduction in charge quantity and increase in proportion of particles charged to an opposite polarity under high temperature and high humidity conditions.

Toners 1*f* and 1*g* had similar characteristics as shown in Table 4 below.

TABLE 4

| | Charge Quantity | |
|---|---|---|
| Measurement Condition | Toner 1f (μC/g) | Toner 1g (μC/g) |
| 22° C., 50% RH | about +16 | about +11 |
| 10° C., 15% RH | about +17 | about +9 |
| 30° C., 85% RH | about +12 | about +6 |

Toners 1*f* and 1*g* are regarded as only marginally useful, although they are slightly dependent on environmental conditions. However, the charge distribution of these toners is slightly broader than that of Toner 1*b*. In particular, Toner 1*g* was observed to contain about 10 wt % of particles charged to an opposite polarity.

The difference in characteristics between Toner 1*f* and Toner 1*g* is probably ascribable to the difference in amount of the surface treating about having an ammonium salt structure.

Copying tests using a two-component developer containing Toner 1*f* or 1*g* and an iron carrier were carried out under various conditions using a modified FX-2300 (a copying machine produced by Fuji Xerox Co., Ltd.)

with a negatively charging organic photoreceptor. As a result, no particular problem was experienced under normal temperature and humidity conditions, and under a low temperature and low humidity conditions. After 300 copies were obtained under conditions of 30° C. and 90% RH, the copying machine containing the developer therein was left to stand overnight under these conditions. When copying was resumed the next morning, problems occurred, such as scratches or slips, defects or fogging of the image with both Toners 1*f* and 1*g*. In particular, the image obtained using Toner 1*f* had conspicuous defects and scratches, and the image obtained by using Toner 1*g* had fewer defects and scratches than that using Toner 1*f*, but was fogged.

The cause of these drawbacks is not clear, but it is assumed that the unsaturated bond in the silane compound used in Toners 1*f* and 1*g* underwent denaturation and deterioration under stresses within the copying machine, such as high temperature, high humidity, high ozone concentration, high electrical field, or other conditions caused by these conditions of operation.

EXAMPLE 2

| | |
|---|---|
| Styrene/butyl acrylate copolymer (Tg: 60° C.; Mn: 4000; Mw: 11000) | 50 parts |
| Styrene/butyl acrylate/divinylbenzene copolymer (Tg: 60° C.; gel fraction: 50%; ratio: 72/28/0.5) | 50 parts |
| Polypropylene wax (m.p. about 150° C.) | 4 parts |
| Carbon black (Regal 330) | 6 parts |
| Cetylpyridinium chloride | 1 part |

A mixture consisting of the above components was melt-kneaded, pulverized, and classified to obtain a toner having an average particle size of about 12 μm. To the resulting toner were added 0.6 wt % of the same silane compound-treated silica as used in Toner 1*b* of Example 1 and 0.5 wt % of methyl methacrylate/perfluoroacrylate copolymer (ratio: 95/5) particles having an average particle size of about 0.3 μm, and the toner composition was then combined with a ferrite carrier having a particle size of about 80 μm which had been coated with polyvinylidene fluoride to prepare a two-component developer having a toner concentration of 4 wt %.

A copying test was carried out using the resulting developer on a modified FX-2830 (a copying machine manufactured by Fuji Xerox Co., Ltd.) using an organic photoreceptor to obtain 50,000 copies under each of low temperature and low humidity conditions (10° C., 10% RH, hereinafter the same), normal temperature and normal humidity conditions (22° C., 55% RH, hereinafter the same), and high temperature and high humidity condition (30° C., 87% RH, hereinafter the same) (150,000 copies in total). As a result, copies having satisfactory and stable image quality were consistently obtained.

EXAMPLE 3

A silica fine powder having a particle size of about 0.012 μm was treated with the same surface treating agent as used in Toner 1*b* of Example 1 at the silica/silane compound ratio of 100/15, after which it was further treated with hexamethyldisilazane at a silica/hexamethyldisilazane ratio of 100/5.

The same toner as prepared in Example 2 was mixed with 0.6 wt % of the thus treated silica and 0.6 wt % of zinc stearate. The resulting toner composition was combined with the same carrier as used in Example 2 to prepare a two-component developer having a toner concentration of 4 wt %.

A copying test was carried out using the resulting developer in the same manner as in Example 2 to obtain 30,000 copies in total. As a result, copies having satisfactory and stable image quality were consistently obtained under all environmental conditions.

EXAMPLE 4

The same silica fine powder as used in Example 1 was treated with a silane compound shown below at the silica/silane compound ratio of 100/10.

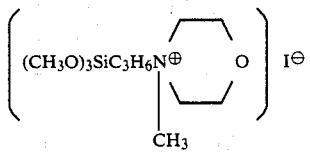

The toner of Example 2 was mixed with 0.6 wt % of the thus-treated silica and 0.5 wt % of methyl methacrylate copolymer particles (Mw: 150,000), and the toner composition was mixed with the same carrier as used in Example 2 to prepare a two-component developer having a toner concentration of 4 wt %. As a result of a copying test using a modified FX-2830, 100,000 copies having satisfactory image quality were consitently obtained.

EXAMPLE 5

A copying test was carried out using the toner composition as prepared in Example 2 as a one-component developer in a modified FX-2830 using the one-component developing apparatus and organic photoreceptor as shown in the accompanying FIG. 1 to obtain 5,000 copies under each of low temperature and low humidity conditions, normal temperature and normal humidity conditions, and high temperature and high humidity conditions (15,000 copies in total). The copies obtained always had satisfactory image quality.

In FIG. 1, developing means 2 is positioned close to electrostatic latent image holder 1 (photoreceptor), having an electrostatic latent image 9 thereon. Developing means 2 has hopper 3 having an opening at the side of latent image holder 1, by which toner 4 is supplied. In hopper 3 is fixed toner carrying roll 5, a part of which projects from the opening toward latent image holder 1. Toner carrying roll 5 is a roll made of a composite material containing a thermosetting resin, carbon black, a reinforcing filler, etc. as main components, and has a smooth surface or a moderate surface roughness. Toner carrying roll 5 rotates on its axis in, for example, the direction indicated by the arrow by a driving system (not shown). If necessary, a direct and/or alternating bias is applied to toner carrying roll 5 by amount source 6. Toner carrying roll 5 is equipped with toner layer controlling element 7 for uniformly adhering toner particles to toner carrying roll 5 in a very thin, e.g., single or double layer. Electric source 8 is connected to toner layer controlling element 7. Toner carrying roll 5 has an electrical resistance of about $10^{10}$ Ω.cm.

Toner layer controlling element 7 is composed of a stainless steel blade having formed thereon a composite rubber layer comprising a fluorosilicone elastomer and various fillers in a thickness of about 1 mm and contacts toner carrying roll 5 under a linear pressure of about 100 g/cm.

In carrying out development, the distance between toner carrying roll 5 and photoreceptor 9 was fixed at about 200 μm, the toner carrying roll was rotated at a peripheral speed of 120 mm/sec, and a direct bias of 300 V and an alternating bias of 2.4 kVp-p (peak-to-peak) at 2.5 kHz were applied.

EXAMPLE 6

Each of zirconium oxide (particle size: ca. 0.01 μm); Ni-Zn ferrite (particle size: ca. 0.015 μm), a complex compound of calcium carbonate, silicic acid, and zinc (particle size: ca. 0.018 μm), alumina (particle size: ca. 0.02 μm); titanium oxide (particle size: ca. 0.03 μm); Al-Si mixed oxide (particle size: ca. 0.015 μm); and needle-like talk (Mg-Si mixed oxides; width: ca. 0.01 μm; length: ca. 0.1 μm) was treated with the same silane compound as used in Example 1 at an inorganic powder/silane compound ratio of 100/10.

Toner 1*a* of Example 1 was mixed with 0.8 wt % of each of the resulting surface-treated inorganic powders and then combined with a ferrite carrier having a particle size of about 80 μm having been surface treated with a perfluorosilane type coupling agent, whereby a two-component developer having a toner concentration of 4 wt % was obtained.

When each of the resulting developers was subjected to a copying test on a modified FX-2300 under low temperature and low humidity conditions, normal temperature and normal humidity conditions and high temperature and high humidity conditions to obtain 100 copies each 9300 copies in total), all the copies obtained had a clear image free from fog.

EXAMPLE 7

| | |
|---|---|
| Styrene/dimethylaminoethyl methacrylate/ n-butyl methacrylate copolymer (Tg: 60° C.; Mn: 15000; Mn: 42000; ratio: 65/2/33) | 95 parts |
| Copper phthalocyanine pigment | 5 parts |

A mixture of the above components was melt-kneaded, pulverized, and classified to obtain a blue toner having an average particle size of 9 μm.

Tin oxide-based mixed oxide fine particles having a particle size of about 0.2 μm were immersed to in a solution of the same silane compound used in Example 1, stirred for 30 min, air-dried and then heated for 2 hours, whereby the surface-treated fine particles having an inorganic powder/silane compound ratio of 100/2 were obtained.

The above prepared blue toner was mixed with 1 wt % of the above-obtained surface-treated tin oxide particles and 0.8 wt % of the same surface-treated silica as obtained in Example 1, and the resulting toner composition was combined with the same carrier as used in Example 6 to prepare a developer having a toner concentration of 4 wt %.

A copying test was carried out using the resulting developer in a modified FX-2300 to obtain 1000 copies. As a result, very clear blue images were obtained under all environmental conditions.

EXAMPLE 8

| | |
|---|---|
| The resin binder as used in Example 7, with the dimethylamino moiety thereof being neutralized with sulfuric acid | 95 parts |
| Copper phthalocyanine pigment | 5 parts |

A mixture of the above components were melt-kneaded, pulverized, and classified to obtain a blue toner having an average particle size of 10 μm. The toner was mixed with 0.8 wt % of the same surface-treated silica as obtained in Example 1 and 0.8 wt % of zinc stearate, and the resulting toner composition was mixed with the same carrier as used in Example 6 to prepare a developer having a toner concentration of 4 wt %.

A copying test was carried out using the resulting developer in a modified FX-2300 to obtain 3000 copies. As a result, clear blue copies were consistently obtained under all environmental conditions.

EXAMPLE 9

Toner 1*b* of Example 1 was combined with a resin/-magnetite dispersion carrier having an average particle size of about 50 μm and having the following formulation.

| | |
|---|---|
| Styrene/perifluoroacrylate/butyl acrylate copolymer (Tg: 70° C.; Mn: 37000; Mw: 151000; ratio: 80/10/10) | 30 parts |
| Magnetite (particle size: about 0.4 μm; EPT-1000 produced by Toda Kogyo Co., Ltd.) | 70 parts |

A copying test was carried out using the thus-prepared developer in a modified FX-2300 to obtain 3000 copies. The resulting copies had a more satisfactory image quality than that obtained by using Toner 1*b*.

EXAMPLE 10

| | |
|---|---|
| Styrene/2-vinylpyridine/butyl acrylate copolymer (Tg: 60° C.; Mn: 7000; Mw: 23000; ratio: 75/5/20) | 20 parts |
| Styrene/butyl acrylate copolymer (Tg: 60° C.; Mn: 130000; Mw: 417000; ratio: 72/28) | 25 parts |
| Styrene/ethylene graft copolymer wax (ratio: 85/15; Mn: 5200, Mw: 13000) | 5 parts |
| Polyethylene was (Sun wax 171P producted by Sanyo Kasei Co.) | 3 parts |
| Surface-treated magnetite (particle size: ca. 0.4 μm; prepared by treating magnetite (EPT-1000) with 1 wt % of the silane compound as used in Example 1 in a wet process in the same manner as in Example 7) | 50 parts |

A mixture consisting of the above components was melt-kneaded, pulverized, and classified to obtain a magnetic toner having a particle size of about 12 μm. The resulting toner was mixed with 0.3 wt % of the same surface-treated silica as prepared in Example 4 and 0.2 wt % of carbon black to prepare a one-component developer.

A copying test was carried out using an FX-2700 (a copying machine manufactured by Fuji Xerox Co., Ltd.) to obtain 10,000 copies. As a result, consistent and satisfactory copies were constantly obtained under all environmental conditions.

EXAMPLE 11

| | |
|---|---|
| Styrene/butyl acrylate copolymer (Tg: 60° C.; Mn: 15000; Mn: 38000; ratio: 76/24) | 95 parts |
| Quinacridone pigment | 5 parts |
| Distearyldimethylammonium tosylate | 1 part |
| Surface-treated tin oxide fine particles (the same as used in Example 7) | 10 parts |

A mixture consisting of the above components was melt-kneaded, pulverized, and classified to obtain a magenta toner having a particle size of about 12 μm. The resulting magenta toner was mixed with 0.6 wt % of the same surface-treated silica as used in Example 1.

A copying test was carried out using the resulting developer in a modified FX-2300 in the same manner as in Example 1, to obtain 1000 copies having very satisfactory quality.

EXAMPLE 12

A one-component developer was prepared in the same manner as in Example 10, except for replacing the surface-treated silica of Example 4 with 1 wt % of silica particles having been treated in a wet process as in Example 7 with a surface treating agent represented by formula

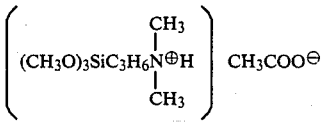

When a copying test was carried out using the resulting developer to obtain 2000 copies in the same manner as in Example 10, satisfactory copies were obtained as in Example 10.

EXAMPLE 13

Silica fine powders having a particle size of 0.012 μm were treated with a surface treating agent of formula

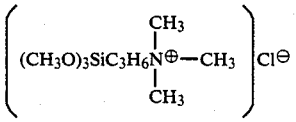

and dimethyldimethoxysilane at a surface treating agent/dimethyldimethoxysilane/silica ratio of 10/5/100.

The toner as prepared in Example 8 was mixed with 0.6 wt % of the thus surface-treated silica and 0.6 wt % of zinc stearate, and the resulting toner composition was combined with the same carrier as used in Example to prepare a two-component developer having a toner concentration of 4 wt %.

When a copying test was carried out using the resulting developer in a modified FX-2300 to obtain 10,000 copies, stable and satisfactory blue copies were consistently obtained under all environmental conditions.

EXAMPLE 14

Alumina powder having a particle size of 0.02 μm was surface-treated with a silane compound of formula

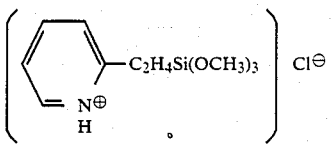

at a silane compound/alumina ratio of 5/100.

The toner as prepared in Example 8 was mixed with 0.8 wt % of the surface-treated alumina and 0.8 wt % of polymethyl methacrylate copolymer fine particles, and the resulting toner composition was combined with the same carrier of Example 8 to prepare a two-component developer having a toner concentration of 4 wt %.

A copying test was carried out using the resulting developer in the same manner as in Example 8 to obtain 10,000 copies. As a result, satisfactory image quality was constantly obtained under all environmental conditions.

While the invention has been described in detail and with reference to specific embodiments thereof, it will be apparent to one skilled in the art that various changes and modifications can be made therein without departing from the spirit and scope thereof.

What is claimed is:

1. A toner composition comprising (i) toner particles comprising a binder resin and a pigment and (ii) an inorganic powder surface-treated with a compound represented by formula $$X'_m SiZ_n'$$

wherein X' represents a group capable of reacting with an inorganic material, selected from the group consisting of a chlorine atom and an alkoxy group, Z' represents a saturated hydrocarbon group containing an onium salt structure or a non-polymerizable unsaturated hydrocarbon group containing an onium salt structure and m and n, which may be the same or different, each represents an integer of from 1 to 3, provided that when m or n is at least 2, the plural groups represented by X' or Z' may be the same or different, and when n is 2, at least one of the plural groups represented by Z' comprises an onium salt structure.

2. The toner composition as claimed in claim 1, wherein said inorganic powder is silica.

3. The toner composition as claimed in claim 1, wherein said toner particles are positively charged toner particles.

4. The toner composition as claimed in claim 1, wherein said binder resin contains an ammonium salt selected from the group consisting of a lower amine salt, a quaternary ammonium salt and a pyridinium salt.

5. The toner composition as claimed in claim 1, wherein said binder resin contains an ammonium salt structure in molecular terminal group or a side chain.

6. The toner composition as claimed in claim 1, wherein $Z_n$ comprises:

(a) a cationic component selected from the group consisting of a trialkylbenzyl quaternary ammonium cation and a cation represented by formulae (I) to (XII):

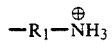
(I)

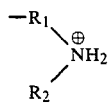
(II)

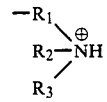
(III)

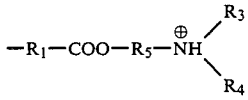
(IV)

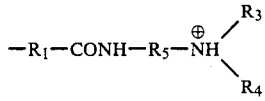
(V)

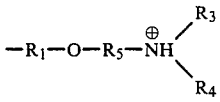
(VI)

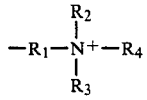
(VII)

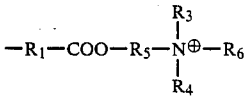
(VIII)

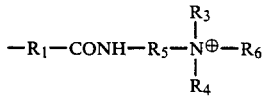
(IX)

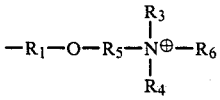
(X)

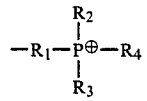
(XI)

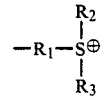
(XII)

wherein $R_1$, $R_2$, $R_3$, $R_4$, and $R_6$, which may be the same or different, each represents a halogen atom and an organic group, provided that any of $R_1$, $R_2$, $R_3$, $R_4$ and $R_6$ may be linked to form a cyclic group, and $R_5$ represents a divalent organic group; and (b) an anionic component selected from the group consisting of a halogen anion, a group having $-COO^{\ominus}$ or $-SO_3^{\ominus}$, and $BF_4^{\ominus}$.

7. The toner composition as claimed in claim 1, wherein $Z_n$ is an ammonium salt.

8. The toner composition as claimed in claim 7, wherein $Z_n$ is selected from the group consisting of lower amine salts, tetraalkylammonium salts, modified trialkylammonium salts, trialkylbenzylammonium salts, tetrabezylammonium salts, pyridinium salts, quinolinium salts, imidazolinium salts, and morpholinium salts.

9. The toner composition as claimed in claim 1, wherein said compound is represented by formula (XIV):

$$X'_m SiZ_n \qquad \text{(XIV)}$$

wherein X' represents a group capable of reacting with an inorganic material selected from the group consisting of a chlorine atom and an alkoxy group; Z represents a saturated hydrocarbon group containing an ammonium salt structure or a non-polymerizable unsaturated hydrocarbon group containing an ammonium salt structure; and m and n, which may be the same or different, each represents an integer of from 1 to 3, provided than when m or n is at least 2, the plural groups represented by X' or Z may be the same or different, and when n is 2, at least one of the plural groups represented by Z comprises an ammonium salt structure.

10. The toner composition as claimed in claim 9, wherein Z represents a saturated hydrocarbon group containing an ammonium salt structure.

11. The toner composition as claimed in claim 1, wherein said inorganic powder is selected from the group consisting of silica, a mixed oxide of silicon and another metallic element, silicon carbide, silicon nitride, silicon, boron nitride, tin oxide, zinc oxide, titanium oxide, alumina, barium titanate, potassium titanate, calcium carbonate, dolomite, barium sulfate, carium oxide, chromium oxide, iron oxide, a ferrite, molybdenum oxide, nickel oxide, magnesium oxide, magnesium hydroxide, zirconium oxide, vanadium oxide, iron, nickel, aluminum, gold, silver, copper, zinc, copper iodide, carbon black, graphite, diamond, and amorphous carbon.

12. The toner composition as claimed in claim 1, wherein aaid inorganic powder has a particle size of from about 0.001 μm to several tens of micrometers.

13. The toner composition as claimed in claim 12, wherein said inorganic powder has a particle size of from about 0.005 μm to 5 μm.

14. The toner composition as claimed in claim 1, wherein said compound is present in an amount of from about 0.5 to 2.0 wt % based on the amount of the inorganic powder.

15. The toner composition as claimed in claim 1, wherein said surface-treated inorganic powder is contained in said toner particles in an amount of from about 0.1 to 30 vol % based on the total volume of said toner particles.

16. The toner composition as claimed in claim 15, wherein said surface-treated inorganic powder is contained in said toner particles in an amount of from about 1 to 20 vol % based on the total volume of said toner particles.

17. The toner composition as claimed in claim 1, wherein said surface-treated inorganic powder is present on the surface of said toner particles in an amount of from about 0.01 to 20 wt % based on the weight of the toner particles.

18. The toner composition as claimed in claim 17, wherein said surface-treated inorganic powder is present on the surface of said toner particles in an amount of from about 0.1 to 10 wt % based on the weight of the toner particles.

19. The toner composition as claimed in claim 1, wherein said toner particles have an average particle size of from about 1 to 20 μm.

20. The toner composition as claimed in claim 19, wherein said toner particles have an average particle size of from about 5 to 15 μm.

* * * * *